US009925590B2

(12) United States Patent
Čelko et al.

(10) Patent No.: US 9,925,590 B2
(45) Date of Patent: Mar. 27, 2018

(54) METHOD OF PREPARATION OF MAGNETICALLY CONDUCTIVE POWDERS BY CAVITATION AND DEVICE TO CARRY OUT THE METHOD

(71) Applicant: Vysoké učení technické v Brně, Brno (CZ)

(72) Inventors: Ladislav Čelko, Nesovice-Letošov (CZ); Miloslav Haluza, Ivančice (CZ); Hynek Hadraba, Brno-Líšeň (CZ); Lenka Klakurková, Brno-Židenice (CZ); Jiří Švejcar, Brno-Štýřice (CZ)

(73) Assignee: VYSOKE UCENI TECHNICKE V BRNE, Brno (CZ)

( * ) Notice: Subject to any disclaimer, the term of this patent is extended or adjusted under 35 U.S.C. 154(b) by 111 days.

(21) Appl. No.: 14/429,228

(22) PCT Filed: Sep. 19, 2013

(86) PCT No.: PCT/CZ2013/000110
§ 371 (c)(1),
(2) Date: Mar. 18, 2015

(87) PCT Pub. No.: WO2014/044233
PCT Pub. Date: Mar. 27, 2014

(65) Prior Publication Data

US 2015/0224577 A1 Aug. 13, 2015

(30) Foreign Application Priority Data

Sep. 19, 2012 (CZ) ..... 2012-646

(51) Int. Cl.
*B22F 9/04* (2006.01)
*B02C 19/06* (2006.01)
*H01F 41/02* (2006.01)

(52) U.S. Cl.
CPC ..... *B22F 9/04* (2013.01); *B02C 19/06* (2013.01); *H01F 41/02* (2013.01); *B22F 2009/045* (2013.01); *B22F 2999/00* (2013.01)

(58) Field of Classification Search
None
See application file for complete search history.

(56) References Cited

U.S. PATENT DOCUMENTS 4,801,411 A * 1/1989 Wellinghoff ..... B01J 13/0095 239/3
6,269,952 B1 * 8/2001 Watt ..... B01J 19/10 209/17

(Continued)

FOREIGN PATENT DOCUMENTS

CN 1416959 A 5/2003
CN 101962210 A 2/2011

(Continued)

OTHER PUBLICATIONS

International Search Report (PCT/ISA/210) dated Feb. 17, 2014, by the European Patent Office in International Application No. PCT/CZ2013/000110, 4 pages.

(Continued)

*Primary Examiner* — George Wyszomierski
(74) *Attorney, Agent, or Firm* — Buchanan Ingersoll & Rooney PC

(57) ABSTRACT

A method of preparing magnetically conductive powders based on principle of liquid flow control in a cavitation line, where in a jet tube are evoked, during the rise of a cavitation cloud and implosion of cavitation bubbles with intensity up to ultrasound frequency 24 kHz, pulse shock waves acting on a surface of a substance whereby are released particles in dimensions in range of micrometer or nanometer units. Particles of the substance from a jet tube are carried away by liquid media into a header where they are captured via a (Continued)

Figure 1:
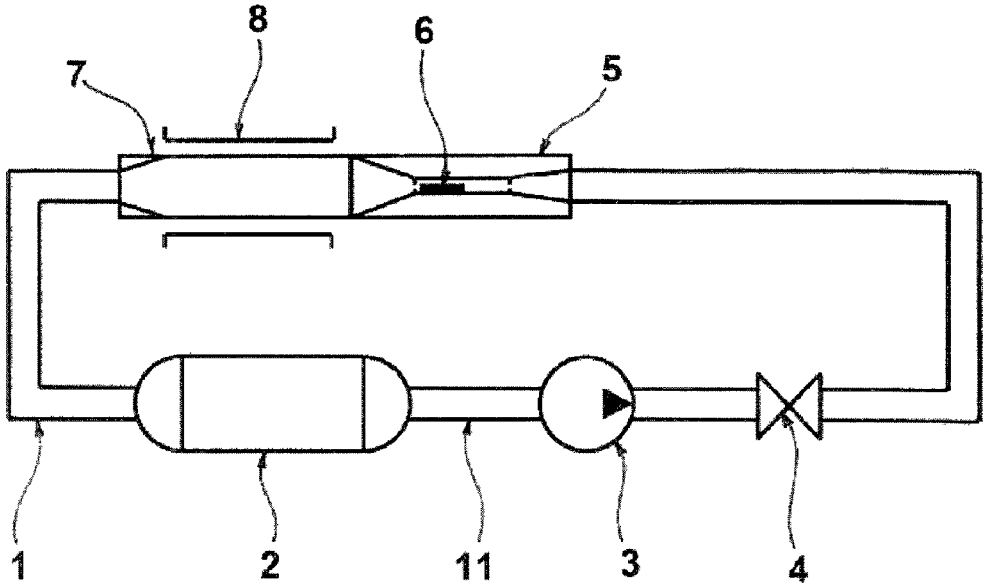

magnetic element. A device includes a cavitation line that is equipped for capture of decavitated particles of the substance by at least one header along which is placed a magnetic element.

7 Claims, 4 Drawing Sheets

(56) References Cited

U.S. PATENT DOCUMENTS

| | | | | |
|---|---|---|---|---|
| 6,824,086 | B1 | 11/2004 | Mazurkiewicz et al. | |
| 7,156,893 | B2 | 1/2007 | Habecker et al. | |
| 7,883,606 | B2 * | 2/2011 | Parkansky | B01J 8/005 204/178 |
| 2010/0176524 | A1 | 7/2010 | Burgess et al. | |
| 2011/0172486 | A1 * | 7/2011 | Pankhurst | A61K 9/0009 600/12 |
| 2011/0277590 | A1 | 11/2011 | Paserin et al. | |

FOREIGN PATENT DOCUMENTS

| | | | |
|---|---|---|---|
| CN | 102175561 | A | 9/2011 |
| CN | 102190299 | A | 9/2011 |
| CZ | 20013359 | A3 | 5/2002 |
| CZ | 300132 | B6 | 2/2009 |
| CZ | 302249 | B6 | 1/2011 |
| CZ | 303197 | B6 | 5/2012 |
| JP | S54140199 | A | 10/1979 |
| JP | H06158121 | A | 6/1994 |
| JP | 2011089156 | A | 5/2011 |
| KR | 20060112546 | A | 11/2006 |
| KR | 20110069909 | A | 6/2011 |
| WO | WO 2008/144838 | A1 | 12/2008 |
| WO | WO 2012/023684 | A1 | 2/2012 |
| WO | WO 2012/047868 | A2 | 4/2012 |

OTHER PUBLICATIONS

Search Report dated May 30, 2013, by the CZ Patent Office in CZ Application No. PV 2012-646, 3 pages.

* cited by examiner

METHOD OF PREPARATION OF MAGNETICALLY CONDUCTIVE POWDERS BY CAVITATION AND DEVICE TO CARRY OUT THE METHOD

ART DOMAIN

The invention is within the area of processing metal materials and concerns the manner of preparing magnetically conductive powders with micrometric and nanometric size of individual particles, which are obtained via cavitation, with the device for the pursuit of this method being a part of the invention.

STATE OF THE ART

Present technologies used for the preparation of powders can be used to produce powders nearly from all known materials but the most common is industrial powder production from highly purified metals and alloys because metal powders are used in particular from the viewpoint of their morphology, size and chemical composition. Currently the most widely used metal powders are in the size range of micro and nano particles. In the case of nanopowders the individual particles are so small that their behaviour is also influenced by atomic force, chemical bond characteristics or quantum effects, and they find application in many industrial branches, where their use enables meeting the specific demands made on them.

Metal powders are usually prepared either by physical methods using mechanical milling or crushing of metal aggregates or by chemical methods while the basic technology for powder preparation can be divided into two basic groups. One group of technologies concerns the area of fine powder preparation, where use is made of atomization methods in water or gas environment, ball milling and/or grinding, mechanical alloying or electrolysis. The other group of technologies is designed for the preparation of nanopowder and its agglomerates, where the method for chemical or electrolytic breakdown of the oxide of required metals is used. The suitability of the method for powder preparation then depends on production speeds, powder characteristics or the physical and chemical characteristics of initial materials. Using special technologies enables the preparation of metal powders ranging in size from nanoparticles (0.01-0.1 μm) through ultra-fine powder (0.1-1 μm) up to fine powder (1-150 μm).

The easiest way of preparing fine metal powders is the method of mechanical grinding or milling, which is used in particular with brittle materials such as cermets, hard metals and oxides or ceramics, where due to their high hardness it is not problematic to obtain a powder with particles of 1 μm ($10^6$ m) in size. There are some technical solutions, described for instance in files KR20110069909, CZ2001-3359 A3, which use for the production of metal powders exactly the methods of milling and grinding. A disadvantage of this technology follows from the fact that most of the metal materials are ductile and the production of fine powder is thus problematic because due to the high toughness the material is rather plasticized and drawn, and the milling device can also become highly contaminated. In the production of metal powders it is also possible to use active gases, when, for example, hydrogen helps to hydridize the material, which increases its brittleness but at the same time changes the chemical, physical and mechanical characteristics of the powder prepared in this way.

A method similar to milling technology is the method of mechanical alloying, which uses attritors or ball mills. An example of using alloying for the production of metal powder is described, for example, in file WO2012047868 A2. Mechanical alloying, which is done via low-energy or high-energy kinetic milling of elemental crystalline powder metals, alloys or chemical compounds, is a method for obtaining powder materials with a fine microstructure, namely nanocrystalline or amorphous. The essence of this method consists in that further additional elements are mixed into the initial material via a series of cold welding processes and subsequent particle division. They can be either particular elements of the periodic system, suitable alloy powders or even their oxides, carbides, nitrides or other ceramic materials. With this method, in particular with a view to increasing the powder fineness, very long process times with a high consumption of active or inert gases are used. Another disadvantage of this technology is that the initial precursors, from which the powder is produced, have to be prearranged, which makes the method more time and cost demanding.

Further way of preparation of metal powders is atomization technology when comes to atomization of melt stream into liquid or gaseous media. The atomization is a dominant method of preparation of metal powders on current market and enables production of metal powders based on Al, Cu, Fe, low and high carbon steel, corrosion resistant, fire resistant and tool steel, super alloys based on Ni and Co, titan alloys, and others. The essence of the atomization is in melting of basic volume precursor and spray of melt drops mostly into gaseous or liquid environment. One option of atomization is plasma chemical break down, as is mentioned for example in files WO 2012023684 A1, US2011277590 A1, US2010176524 A1. Via atomization is normally enabled preparation of the powder with grain size up to 150 μm. Problematic is already preparation of powder in sub micrometric (nanometric) scale, because physical limitation of the essence of creation of metal powders via atomization is at present on the border of grain size 1-5 μm.

For preparation of the powders with nanometric size of particular particles are most commonly used chemical principles and processes when the essence of the powder production are chemical reactions, which cause change of original chemical composition of initial material. The most commonly used technologies for obtaining of resulting metal nano-powder are chemical or electrolytic break down of the oxide, metals, precipitation from dilutions, condensation from vapours, heat break down or electro deposition. These are relatively simple processes when total economic demandingness comes especially from consumption of entry raw materials, electric energy and relatively long working time. However due to high chemical purity of this way produced nano-powders, the purchase price which is requested for these products on the market is relatively high. The method of powder production via chemical way is described for instance in files CN101962210 A, CN102190299 A, KR20060112546, CZ 302249 B6 and CZ 300132 B6.

For preparation of metal powders is used also whole range of other technologies and processes, nevertheless all these processes, used especially for nano-particles production, are energy demanding and purchase costs of the technologies are very high. At present many research teams around the world are occupied by looking for new technologies and processes leading to preparation of nano powders and not only with regard to economical demandingness of the production but also environmental protection and lowering of energy demandingness of production process point of view. One brand new method for preparation of metal powders is cavitation use, thus widely known undesired effect causing permanent and irreversible damage of material of machines and devices operating in aquatic environment. Own mechanism of cavitation consists of formation of significant amount of under pressure produced bubbles in liquid media, which by the surface of the barrier implodes which results in formation of dynamic pressure stress acting directly on the surface of the material and causing gradual separation of parts of the material—decavitation. For setting of cavitation resistance of the materials the cavitation is being artificially caused on specially modified cavitation lines, where by the help of special jet comes to artificial evocation of the cavitation on tested material, where is evaluated weight loss with regard to time. The resistance of the material against cavitation is sum of the characteristics, which can not be clearly classified to firmness, tenacity, hardness, peak load, melting temperature, workability, chemical composition and so on. Very good cavitation resistances have materials with high resistance against plastic deformation, with fine grain homogeny structure, with compression tension in surface level, with high hardness and with high corrosion resistance. On the contrary materials with disposition of corrosion formation, with heterogeneous structure, with inner tension stress, low deformation resistance and rough surface are highly vulnerable to cavitation worn out. In file CN102175561 is then described technical solution which enables material resistance test via cavitation erosion. Testing device is equipped with piping system where is built in water tank, centrifugal pump and Venturi tube which enables formation of cavitation effect. The parameters of flowing media are monitored and regulated by the help of barometers, flow meters and regulation valves set. Further cavitation device, used for liquidation of micro organism in liquid is known from file CZ 303197, where is described device containing mutually serial interconnected components, namely intake part, pump, cavitation pipe and discharge part, where the cavitation pipe is formed from mutually on each other tied together chambers, confusors and diffusers, whereas cavitation pipe can contain more working chambers placed in series or two and more cavitation pipes, which can be connected to connecting pipeline even in parallel way.

The aim of featured invention is to introduce brand new way of metal powders preparation, whose essence is in creation of decavitated substance of magnetically conductive materials in cavitation line, whereas decavitated substance which is carried away by the water flow or another liquid media is after decavitation caught in magnetic field. Featured invention enables partly decrease of purchase and operating costs for device production and shortening process period of metal powders production without necessity of special preparation of initial material, whereas proposed way of metal powders preparation is universal for different types of magnetic materials.

Essence of the Invention

The above mentioned target is reached to considerable extend by featured invention, which is way of preparation of magnetically conductive powders based on principle of liquid flow controlling in cavitation line, where in the jet tube are at formation of cavitation cloud and implosion of cavitation bubbles with intensity up to ultrasound frequency 24 kHz evoked pulse shock waves acting on surface of the substance, whereby release particles in dimension in range of micrometers or nanometers units, where the essence of the invention is in the fact that the substance particles are from jet tube carried away by liquid media into the header, where are caught up via magnetic element.

It is advantageous when is by the help of pump regulated speed of the liquid in cavitation line and position of cavitation cloud in jet tube, where cavitation on the surface of the substance reacts with highest intensity.

Furthermore is advantageous when by lay out or division of the magnetic field rising by activity of magnetic element the decavitated particles of the substance are selectively caught up.

Likewise the essence of the invention is device for preparation of magnetically conductive powders with cavitation use consisting of cavitation line, where is by the help of connecting pipeline built in tank for liquid, at least one pump, at least one stop valve and at least one cavitation jet tube, which is created with confusor, cavitation chamber and diffuser, whereas the cavitation chamber is modified for substance storage, where the cavitation line is, for caught up of decavitated particles, equipped with at least one header along which is placed magnetic element.

In advantageous design the header concurs, in cavitation line, on diffuser of cavitation jet tube, whereas the header is formed by collector pipe with the same or bigger crosscut than is the crosscut of connecting pipeline of cavitation line in the space behind cavitation jet tube.

In an optimal case the magnetic element is placed around the collector pipe of the header along whole its inner or outer perimeter or is situated around part of inner or outer surface of collector pipe, whereas is preferable when the magnetic element is compound of permanent magnet and electromagnet.

In an optimal setting the cavitation line is equipped with mutually interconnected monitoring system and control unit, which is connected with the tank, pump, stop valve, cavitation jet tube and electromagnet of magnetic element.

Moreover is also preferable when the monitoring system contains surface sensor and thermal sensor, which are placed on the tank and is equipped with pressure gauges set, whereas in an optimal case the pressure gauges set contains not only at east two pressure sensors situated in cavitation line for pump suction and on the pump displacement but also at least two pressure readers placed in cavitation chamber and in diffuser of the jet tube.

Likewise is advantageous when the monitoring system contains thermal sensor and flowmeter for control of temperature and speed of the liquid and is equipped with reading unit of sped up liquid media for vibration record which is situated in cavitation chamber of the jet tube.

With this invention is reached, in comparison with to date known solutions, new and higher efficiency in that, that via cavitation is enabled preparation of metal powder directly in nanometric or ultra fine scale, whereas is secured relatively low energy, economic and time demandingness of the production process.

DESCRIPTION OF FIGURES IN ENCLOSED DRAWINGS

Figure 2:
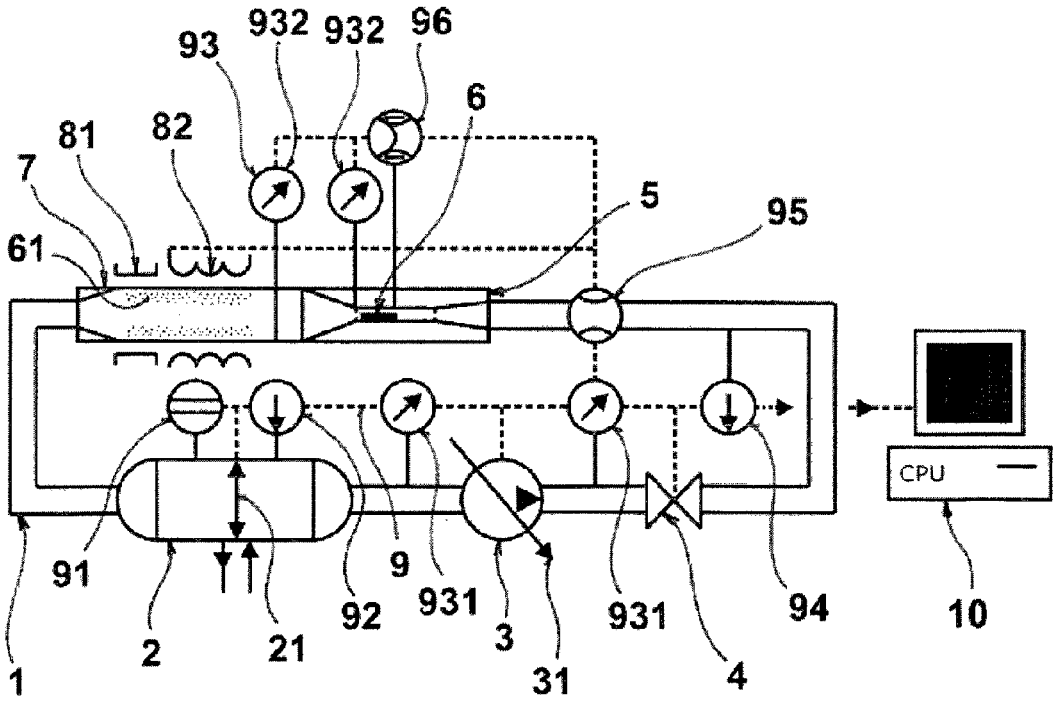
Figure 3:
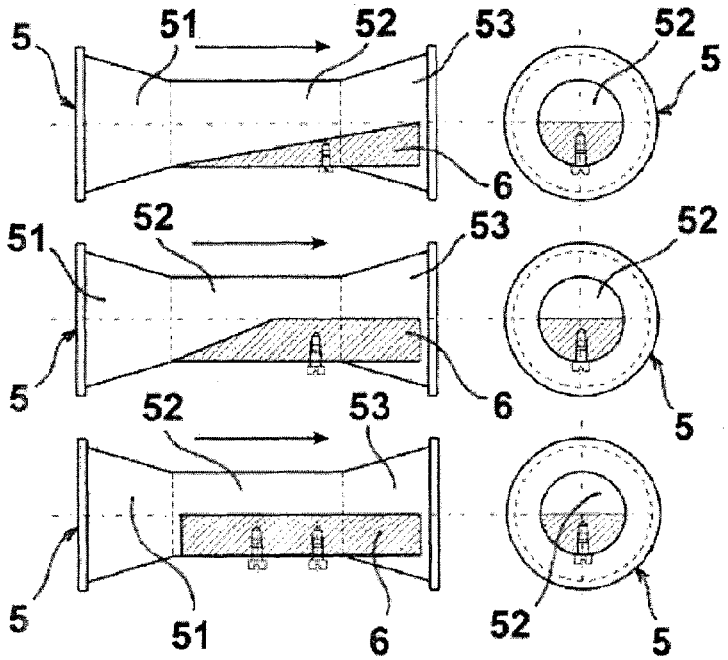
Figure 4:
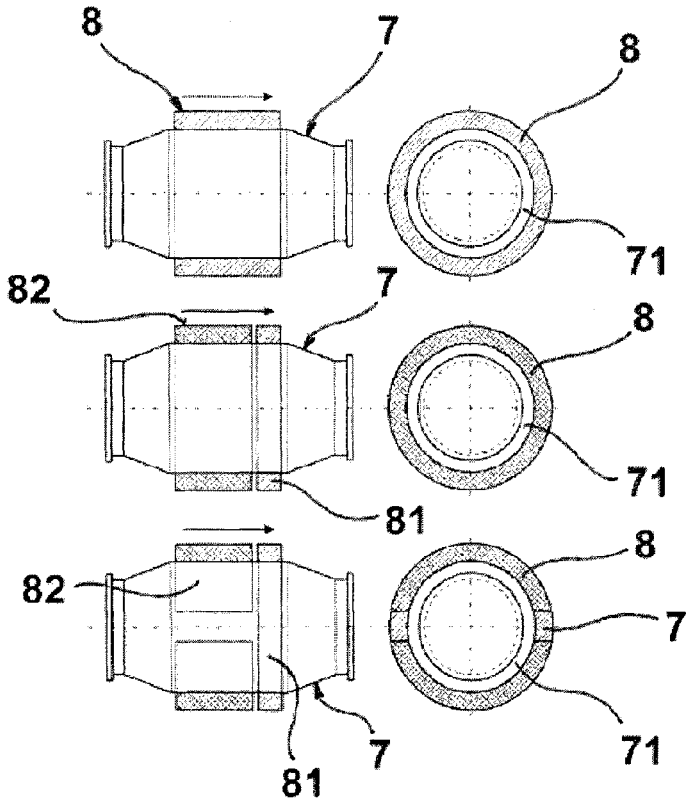
Figure 5:
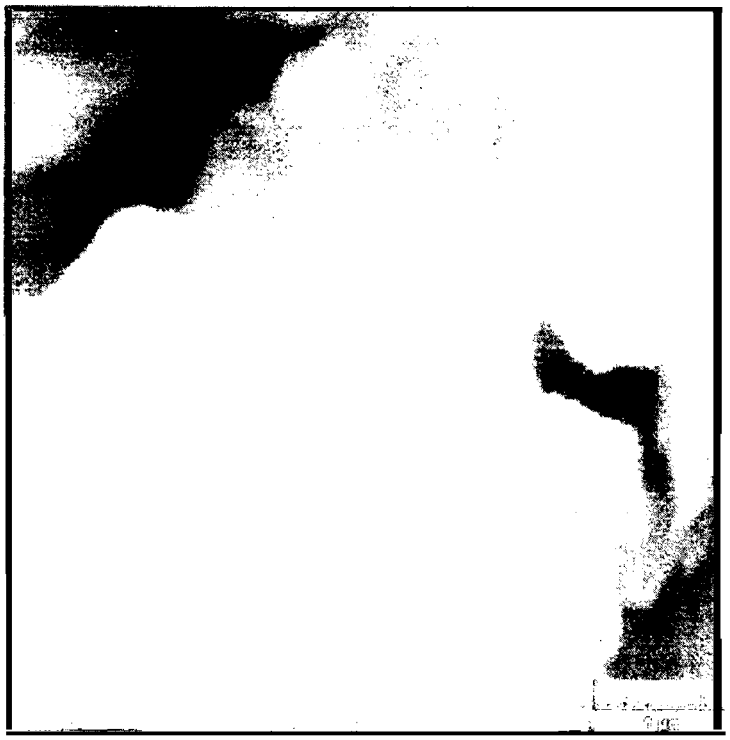
Figure 6:
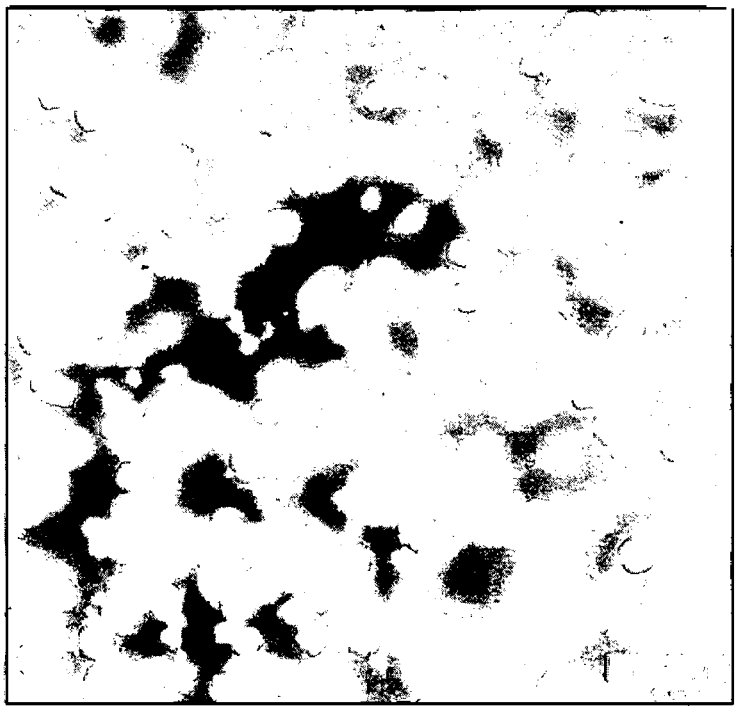
Figure 7:
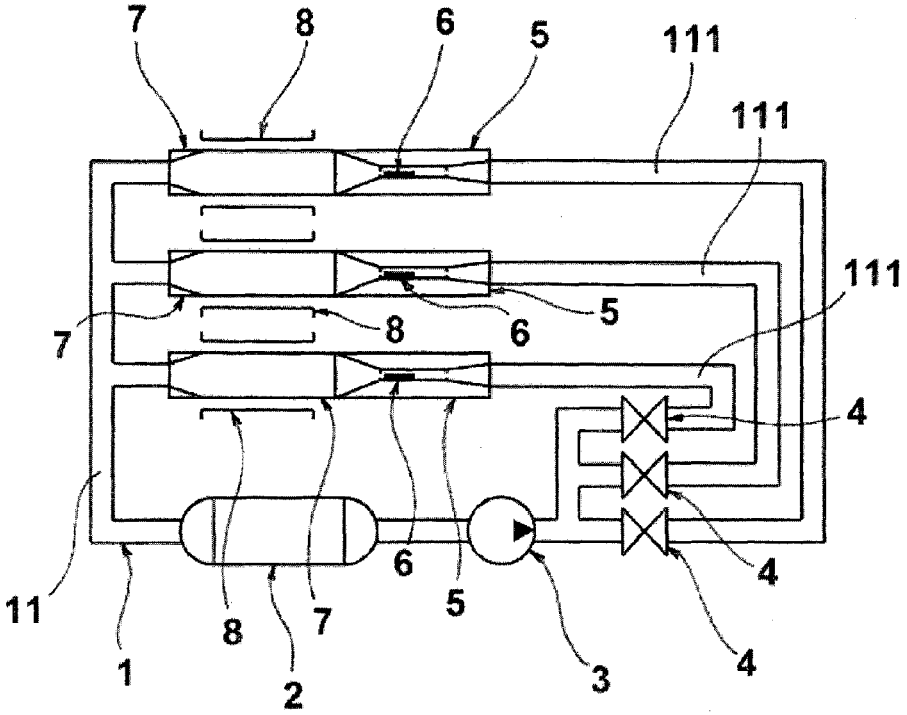
Figure 8:
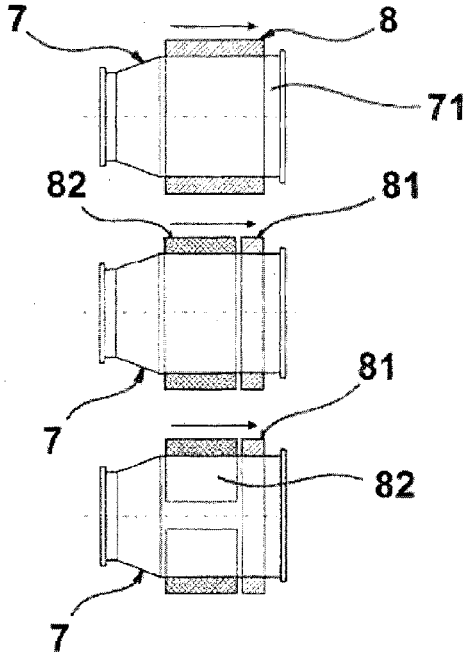

Particular examples of an invention design are simplified illustrated in enclosed drawings, where FIG. 1 is a basic scheme of cavitation device with basic components pro preparation of metal powders, FIG. 2 is an extended scheme of cavitation device with basic and support components, FIG. 3 is a lengthwise and vertical cut of cavitation jet tube in the place of cavitated substance storage, FIG. 4 is a lengthwise and vertical cut of header with variable placing of magnetic system, FIG. 5 is a microscopic picture of the structure of agglomerated nano powder Fe with dimensions in micrometers range, FIG. 6 is a microscopic picture of the structure of non-agglomerated nano powder Fe in dimensions in range smaller than 300 nanometers, FIG. 7 is an alternative design of cavitation device with three level parallel setting of cavitation jet tubes and FIG. 8 is a lengthwise cut of alternative design of header and magnetic system.

The drawings which illustrate featured invention and consequently described examples of particular design do not in any case limit extend of the protection mentioned in definition, but only clarify essence of the solution.

EXAMPLES OF TECHNICAL SOLUTION DESIGN

The device for preparation of metal powders in basic design according to FIG. 1 consists of a cavitation line 1 realized in the form of closed circuit, whereof are series way built in components, namely a tank 2 for a liquid, pump 3, stop valve 4, cavitation jet tube 5 and header 7, where these components are mutually interconnected directly or by the help of connecting pipeline 11 and a cavitation chamber 52 is modified for storage of cavitated substance 6.

An alternative design of the device is schematically illustrated in FIG. 2 where is into the cavitation line 1 built in monitoring system 9 and a control unit 10, whereas to the control unit 10 is connected not only the monitoring system 9 but also even particular control components built in into the cavitation line 1, namely the tank 2, pump 3, stop valve 4, cavitation jet tube 5 and magnetic element 8. In advantageous design the tank 2 is equipped with a cooling system 21 and the pump 3 is equipped with a frequency changer 31. The monitoring system itself 9 contains a feedback surface sensor 91 and a thermal sensor 92 which are placed on the tank 2 and its parts are also a pressure gauge set 93 for monitoring the pressure in the liquid. The pressure gauge set 93 contains two pressure sensors 931 situated in cavitation line 1 on the suction of the pump 3 and on the pump 3 displacement and two pressure readers 932 which are placed directly in the cavitation chamber 52 and in diffuser 53 of the jet tube 5. Likewise is the monitoring system 9 equipped with a feedback comparing thermal detector 94 and a flowmeter 95 for measurement of the speed, of the liquid entering the jet tube 5. Further part of the monitoring system 9 is a scanning unit 96 of liquid media acceleration, which is situated directly in the jet tube 5.

The cavitation jet tube 5 is illustrated in FIG. 3 and consists of several parts which are tied together, when the intake part is formed by a confusor 51 in the shape of a truncated cone, central part by a cylindrical cavitation chamber 52 and discharge part by a diffuser 53 also in the shape of a truncated cone, whereas in the cavitation chamber 52 is firmly settled a cavitated substance 6 in the form of differently shaped magnetically conductive volume material, when the mounting is in exemplary design realized via at least one screw.

On the diffuser 53 of the jet tube 5 concurs a header 7 around which is from the outer side, around perimeter placed a magnetic element 8, whereas the header 7 is realized in the form of a shaped header tube 71 which has on its input and output shape of a truncated cone and in the central part shape of cylinder with bigger crosscut than is the crosscut of the connecting pipe 11 in the space behind the cavitation jet tube 5. The magnetic element 8 itself is either formed by a permanent magnet 81 or consists of a permanent magnet 81 and electromagnet 82. The magnetic element 8 is placed along outer wall of header tube 71 of the header 7, namely either around its whole outer perimeter or only in the part of its outer surface as is clear from FIG. 4.

The preparation of a metal powder in the basic device design proceeds in the way that in the cavitation line 1 is liquid pumped from the tank 2 by the pump 3 into the jet tube 5 where the liquid media goes at first through confusor 51 by which action comes to a significant rise of the liquid speed and simultaneously to decrease of the pressure, namely under the pressure of saturated vapours, whereby in liquid occur first cavitation bubbles which proceed at a very high speed into the cavitation chamber 52. In the space of cavitation chamber 52 where is settled the substance 6 comes to arise of a cavitation cloud and implosion of cavitation bubbles, whereby in the liquid is evoked formation of pulse shock waves acting on the surface of the substance 6. As a result of action of dynamic compression stress, evoked by implosion of cavities in liquid media, on the substance 6 release particles 61 of magnetically conductive materials. The liquid then flows form cavitation chamber 52 into the diffuser 53 where comes to decrease of liquid's speed and gradual expiration of cavitation. Form the diffuser 53 is the liquid led directly into the header 7 where comes to capture of decavitated particles 61 of the substance 6. Very separation of the particles 61 of decavitated substance 6 is enabled thanks to flowing liquid speed reduction in the header tube 71 of the header 7 and by acting of a magnetic field which is emitted by magnetic member 8 where on inner wall of header tube 71 comes to capture of decavitated particles 61 of the substance 6. From the header 7 is by the help of connecting pipe 11 the liquid led back into the tank 2.

In an alternative design the preparation of metal powder proceeds in the way that by the help of monitoring system 9 are monitored and regulated parameters of flowing media, whereas monitoring system 9 and also particular components 2, 3, 4, 5 and 8 which influence cavitation process are connected to a control unit 10, which evaluates, sets and controls process of metal powder production. By the help of a cooling system 21 of the tank 2 comes to liquid cooling, whereas is also controlled replenishment of the liquid or release of the liquid from the tank 2. A pressure reader 932 serves to information record about intensity and position of the collapse of bubbles of cavitation cloud in cavitation chamber 52 and diffuser 53, whereby is enabled efficient control of pump 3 performance and change of position of a cavitation cloud in the jet tube 5.

A scanning unit 96 of liquid media acceleration enables record of vibrations when monitors vibrations in defined axe of Cartesian system, thus at least at entry into the jet tube 5, in the place of intensive cavitation and at output in front of the header 7. To very control of lengthwise shift of a cavitation effect on the surface of the substance 6 and for intensity setting of evoked cavitation in the jet tube 5 serves a frequency changer 31 of the pump 3, whereas by the help of pressure sensors 931 is monitored pressure in the liquid of inlet and displacement of the pump 3. The permanent magnet 81 of the magnetic element 8 then serves in the case of electromagnet 82 plug in into the technology system as a slave unit whose function is to prevent loss of powder production at electric current black out and prevention of possible contamination of cavitation system.

Decavitated particles 61 of the substance 6 captured in the header 7 can be in two states, namely in the form of decavitated nano-powder with dimension in micrometer unit range as is illustrated in FIG. 5 or directly in the form of non-agglomerated particles of the nano-powder with dimension smaller than 300 nanometers as is perceptible from FIG. 6. By lay out or division of a magnetic field of magnetic element 8 is enabled a selective capture of decavitated particles 61 of the substance 6, namely without the presence of liquid or with permanent presence of the liquid where is in highly reactive materials possible to prevent undesired reaction with surrounding environment, for example oxidation.

Described setting of cavitation line 1 realized in the form of one circuit pipe system is not the only possible design of the invention. As is illustrated in FIG. 7 the connecting pipe 11 of the cavitation line 1 can be realized in three parallel set pipe shoulders 111 where each pipe shoulder 111 is equipped with independent stop valve 4, jet tube 5, header 7 and magnetic element 8. The number of this way connected pipe shoulders 111 of the cavitation line 1 is not limited. Further the magnetic element 8 can emit magnetic field with constant intensity or intensity relative in the direction of flow from the weakest to the strongest. The permanent magnets 81 and/or electromagnets 82 are placed on the outer side of the header tube 71 of the header 7, whereas they can be placed also inside around whole inner diameter of the header 7 and can be realized as divided ones and be placed either in the lower part of the header 7, where flows the liquid, and/or in upper part where on the contrary liquid does not flow. In an alternative design can be for example magnetic element 8 formed by protective polymer film coated on inner wall of the header tube 71 of the header 7. The crosscut of connecting pipe 11 of the cavitation line 1 or header tube 71 of the header 7 can have circular, elliptical, rectangular, polygonal, figurate, irregular or mutually combined shape, whereas the header 7 is formed by header tube 71 with the same or bigger crosscut then is the crosscut of the connecting pipe 11 of the cavitation line 1 in the space behind jet tube 5 as is evident form FIG. 8. The examples of substance 6 mounting in the jet tube 5 and its shape clarify only essence of the mounting with the screws, however the mounting can be done also in another way for example with groove, weld, slid-in mechanism, by the help of glue and so on.

The way of preparation of magnetically conductive powders according to the invention is based on principle of the control of liquid flow in cavitation line 1 where is evoked cavitation acting on surface of inserted substance 6. Efficient evocation and action of the cavitation is realized in jet tube 5 in whose work cavitation chamber 52 is partly settled the substance 6 and partly comes to rise of cavitation cloud and implosion of cavitation bubbles with intensity up to ultrasound frequency 24 kHz, whereby is evoked rise of dynamic compression stress acting on surface of the substance 6. By the help of the pump 3 is possible to regulate speed of the liquid in cavitation line 1 whereby is in the lengthwise direction controlled shift of the place where the cavitation on the surface of the substance 6 acts with highest intensity. From decavitated surface of the substance 6 are released ultra fine particles 61 in dimension of nanometers or micrometers unit range. These particles 61 of the substance 6 are from the jet tube 5 carried away by the liquid media into the header 7, where comes to their separation form the liquid flowing further in closed system. The very separation of decavitated particles 61 of the substance 6 is enabled via reduction of the speed of flowing liquid at interaction of magnetic field emitted from magnetic element 8 where on the inner wall of the header 7 comes to capture of decavitated particles 61 of the substance 6. By suitable lay out or division of magnetic field of magnetic element 8 is enabled selective capture of decavitated particles 61 of the substance 6 for example in upper part of the header tube 71 which is in surrounding atmosphere already without presence of flowing liquid or in the lower part of the cavitation chamber 52 which is in permanent contact with flowing liquid and in highly reactive materials can be this way avoided undesired reaction with surrounding environment.

INDUSTRIAL UTILITY

Featured invention belongs to area of powder metallurgy and production of metal powders with nanometric or micrometric size of individual particles, whereas especially use of the nano-materials is much extended with possibility of exercise in many different industrial branches as is healthcare, engineering, civil engineering, chemical industry, textile industry or electro-technical industry.

LIST OF REFERENCE NUMERALS

1 cavitation line
11 connection pipe
111 pipe shoulder
2 tank
21 cooling system
3 pump
31 frequency changer
4 stop valve
5 jet tube
51 confusor
52 cavitation chamber
53 diffuser
6 substance
61 particles
7 header
71 header tube
8 magnetic element
81 permanent magnet
82 electromagnet
9 monitoring system
91 surface sensor
92 thermal sensor
93 pressure gauge set
931 pressure sensor
932 pressure reader
94 regulation thermal detector
95 flowmeter
96 scanning unit
10 control unit

The invention claimed is:

1. A method of preparing magnetically conductive powders based on principle of liquid flow control in a cavitation line comprising evoking, in a jet tube during the rise of a cavitation cloud and implosion of cavitation bubbles with intensity up to ultrasound frequency 24 kHz, pulse shock waves acting on a surface of a substance which is fixed to the jet tube, to thereby release particles, of the substance including one or more of microparticles or nanoparticles, wherein the particles of the substance are carried away from the jet tube by liquid media into a header where they are captured via magnetic element.

2. The method according to claim 1, further comprising regulating, by a pump, speed of the liquid in the cavitation line and the position of cavitation cloud in the jet tube where the cavitation on the surface of the substance acts with the highest intensity.

3. The method according to claim 1, wherein decavitated particles of the substance are selectively captured by virtue of the lay out or division of a magnetic field created by acting of the magnetic element.

4. The method according to claim 1, wherein the substance is mounted to the jet tube.

5. The method according to claim 1, wherein the substance is mounted to the jet tube by at least one screw.

6. The method according to claim 1, wherein the substance is mounted to the jet tube by at least one mounting member.

7. The method according to claim 1, wherein the substance is attached to the jet tube at at least two locations on the substance.

* * * * *